United States Patent [19]

Green

[11] Patent Number: 4,850,125

[45] Date of Patent: Jul. 25, 1989

[54] PICTURE FRAMING APPARATUS

[76] Inventor: Peter F. Green, P.O. Box 56277, New Orleans, La. 70156

[21] Appl. No.: 52,016

[22] Filed: May 19, 1987

[51] Int. Cl.[4] ..... A47G 1/06

[52] U.S. Cl. ..... 40/152

[58] Field of Search ..... 40/152, 152.1, 155

[56] References Cited

U.S. PATENT DOCUMENTS

| | | | |
|---|---|---|---|
| 2,223,674 | 12/1940 | Cohen | 40/152 |
| 3,060,606 | 10/1962 | Peach . | |
| 3,996,682 | 12/1976 | Schwartz | 40/152 X |
| 4,523,400 | 6/1985 | Seely . | |
| 4,525,945 | 7/1985 | Shultz | 40/152 |

FOREIGN PATENT DOCUMENTS

| | | | |
|---|---|---|---|
| 2501990 | 7/1976 | Fed. Rep. of Germany | 40/152 |
| 2456496 | 12/1980 | France | 40/152 |
| 2127741 | 4/1984 | United Kingdom | 40/152 |

*Primary Examiner*—Robert G. Nilson

*Attorney, Agent, or Firm*—Pravel, Gambrell, Hewitt, Kimball & Krieger

[57] ABSTRACT

Apparatus for framing pictures comprises a picture framing member whose appearance can be quickly and easily altered due to the internal configuration of the front and/or side elements of the framing member. In preferred embodiments, the framing member is made of a transparent material, and cavities or inwardly-opening recesses are formed in the framing member to allow the framing member to receive decorative inserts therein to alter its appearance. In other embodiments, an outwardly-opening recess is provided in the framing member. Since at least part of an insert placed in this recess is exposed, the framing member need not be made of transparent material, as the insert is visible even if the framing member is made of opaque material.

11 Claims, 4 Drawing Sheets

PICTURE FRAMING APPARATUS

BACKGROUND OF THE INVENTION

1. Field of the Invention

The present invention relates to apparatus for picture framing.

2. General Background of the Invention

Framed picture units typically comprise a picture assembly of a transparent protective cover (made of glass or plastic), a mat, a picture, and a backing board (in that order from front to back), the outside edges of which are encased in a frame. The most common frames are rectangular in plan, and typically comprise four framing members which are joined together with ends mitered at a 45° angle. The framing members may be made of, for example, wood, metal or plastic. When made of wood, the framing members have an outer surface that is typically decoratively shaped or carved, and an inner surface. The inner surface is usually L-shaped in cross-section, comprising a flat front surface which engages the protective cover and a flat side surface. When using wooden framing members, the members are usually glued or nailed together to form the frame, the assembly is placed in the frame with the protective cover engaging the front inner surface, and tacks or other retaining members are driven into the flat inner side surface of each framing member to secure the picture assembly in the frame.

While wood has, for years, been perhaps the most common framing material, metal and plastic frames are also becoming common. Most metal framing members, like wooden framing members, also have mitered ends cut at a 45° angle, but the means for joining them together is usually different.

Common metal framing members have a front element, an outer side element adjacent and perpendicular to the front element, a back element which is parallel to the front element and disposed intermediate the front and back edges of the outer side element, and an inner side element which is parallel to the outer side element. A groove is formed by the back element, that portion of the outer side element which is behind the back element, and the inner side element. The inner side element extends from the back element as far back as does the outer side element. The groove is partially closed by two coplanar lips, one adjacent and connected to the back edge of each side element. The metal framing members are joined together with joiner members which are L-shaped in plan. These joiner members typically comprise two discrete elements which are substantially equal in size and in shape in plan. One of these elements has two threaded holes, one in each leg of the L, and screws disposed in the holes. The legs of the L are slightly narrower than the distance between the inner and outer side elements, but wider than the opening between the coplanar lips. Two adjacent metal framing members are joined together by inserting a leg of the joiner member in the groove of each framing member, sliding the framing members together, then tightening the two screws of the joiner members. Tightening the screws forces the L-shaped elements apart, causing the blank element to engage the back element of the framing members, and the element having screw holes therein to engage the lips of the groove. Three metal framing members are thus joined, then the picture assembly is slid into the space between the front and back elements of the framing members, with the transparent protective cover engaged with the back surface of the front elements of the three framing members. The fourth framing member is then joined to the second and third framing members, and springs are placed between the backing board and the back elements to secure the picture assembly within the frame.

Various types of plastic picture framing members are known. U.S. Pat. No. 3,060,606 discloses a plastic framing member which is shaped such that it clips onto a picture assembly. The framing member may be colored by conventional polyethylene treatment. U.S. Pat. No. 4,523,400 discloses another plastic picture framing member. A plurality of members are joined together with L-shaped corner braces to form a picture frame. A simulated metal or simulated wood laminate may be applied to the outer surfaces of the framing member. A clear acrylic framing member is disclosed in U.S. Pat. No. 4,525,945. The front and back surfaces of the framing member are highly polished such that the framing member is transparent from front to rear. The side surface of the framing member is frosted to conceal the connecting hardware, which comprises L-shaped corner fasteners, from front view.

The above-mentioned wood, metal and plastic framing members are usually cut out of 8′–10′ lengths of framing material. These lengths of framing material are usually sold in bulk quantities to frame shops. If a particular color frame is needed for a particular picture, and the frame shop does not have this color in stock, it must either special-order framing material of that color, paint framing material that it has, or lose the sale (which is what most often happens). Special-ordering usually results in time delays and added expense, since bulk quantity discounts generally do not apply to special orders of a few lengths of framing materials. Likewise, painting the framing material can be time consuming and labor intensive, especially if the particular color of paint must be specially mixed. In addition, some customers may not like the appearance of any of the framing material which is in stock at the frame shop, but may desire framing material which is very similar in appearance to some material at the frame shop. It can be seen that there exists a need for framing material whose appearance can be quickly, easily and economically altered.

SUMMARY OF THE INVENTION

The present invention comprises a picture framing member whose appearance can be quickly, easily and economically altered, after manufacture of the framing material out of which it is cut. At least one of the front and side elements is internally configured to allow the element to receive inserts therein to alter the appearance of the framing member.

In preferred embodiments of the present invention, the framing member is made of transparent plastic, such as clear acrylic, and cavities or inwardly-opening recesses are provided in the front and/or side elements of the member to allow an appearance-altering material to be received therein.

In another embodiment of the present invention, outwardly-opening recesses are provided in the front and/or side elements of a framing member to allow an appearance-altering material to be received therein. In these embodiments, the framing member may, but need not, be made of transparent material.

It is an object of the present invention to provide a framing member whose appearance can be quickly, easily and economically altered.

Another object of the present invention is to provide a framing member having recesses and/or cavities in its front and/or side elements to allow appearance-altering material to be received therein.

BRIEF DESCRIPTION OF THE DRAWINGS

For a further understanding of the nature, objects and advantages of the present invention, reference should be had to the following detailed description, taken in conjunction with the accompanying drawings, in which like reference numerals denote like elements, and wherein.

DETAILED DESCRIPTION OF THE PREFERRED EMBODIMENTS

Figure 1:
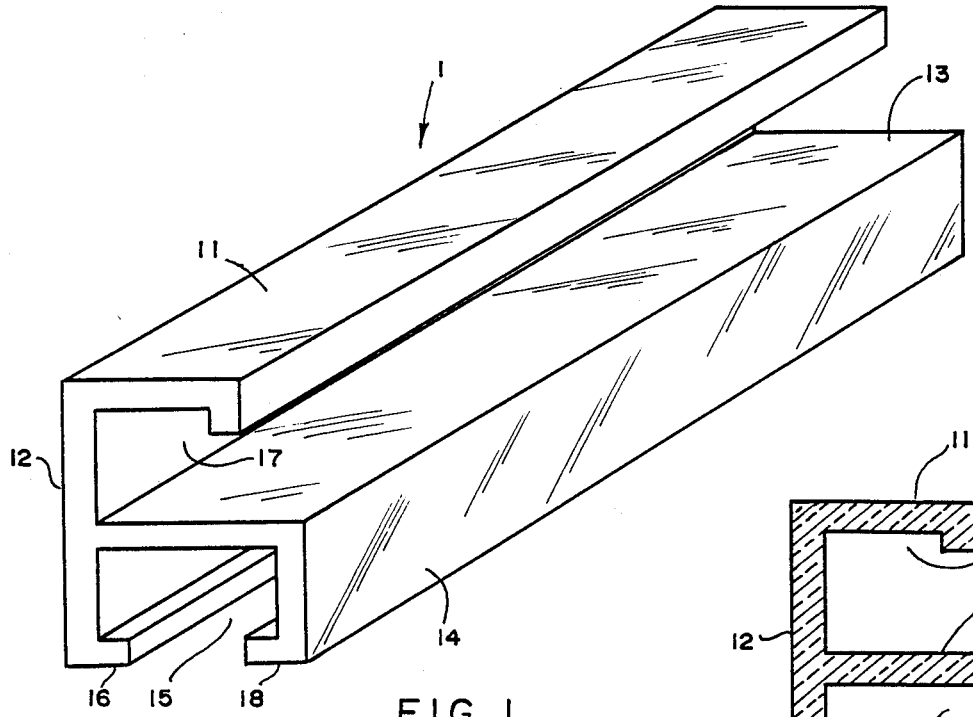
FIG. 1 is a perspective view of framing material in accordance with the preferred embodiment of the present invention.
Figure 2:
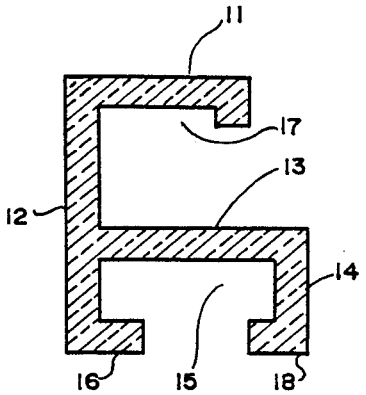
FIG. 2 is a cross-sectional view of the framing material shown in FIG. 1.
Figure 3:
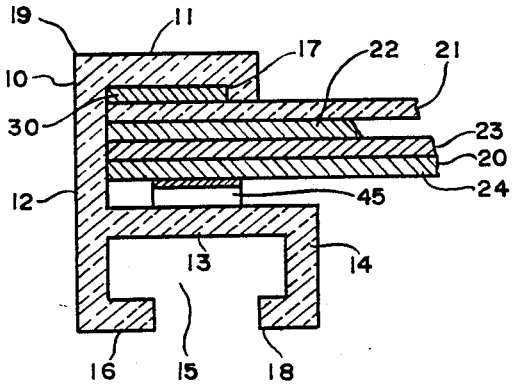
FIG. 3 is a cross-sectional, partially cutaway view taken along lines III—III in FIG. 4.

Referring now to the drawings, the preferred embodiment of the present invention is shown in FIGS. 1–6. Framing material 1 is constructed of a transparent plastic material and comprises a front element 11, an outer side element 12 adjacent and perpendicular to front element 11, a back element 13 which is parallel to front element 11 and is disposed intermediate the front and back edges of outer side element 12 and an inner side element 14 which is parallel to the outer side element 12 and extends from back element 13 as far back as does outer side element 12.

A groove 15 is formed by back element 13, the portion of outer side element 12 which is behind back element 13, and inner side element 14. Groove 15 is partially closed by lips 16 and 18, which are coplanar and which are parallel to back element 13. Lips 16 and 18 are perpendicularly connected to the back edges of side elements 12 and 14, respectively. Groove 15 serves to allow framing members 10 to be joined together, as will be described further.

An inwardly-opening recess 17 is provided in front element 11. Recess 17 serves to receive an appearance altering material for frame member 10. Recess 17 is preferably deep enough to receive mat board. Many frame shops daily discard large quantities of mat board because the mat board is in strips which are so narrow that a single-piece mat cannot be cut out of them. Inserts for recess 17 could advantageously be cut out of these strips of mat board, thereby making use of a commodity which would otherwise be thrown away.

Figure 4:
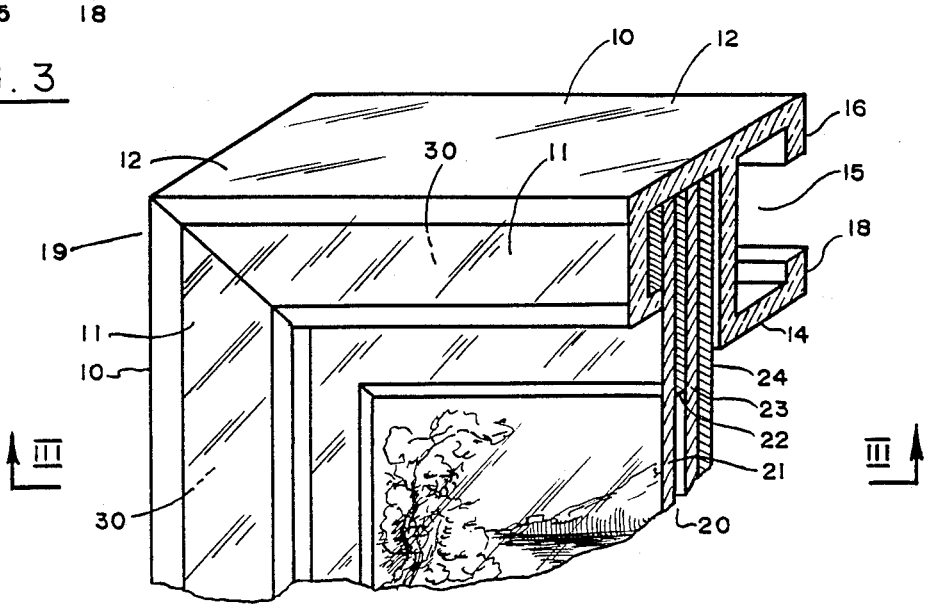
FIG. 4 is a perspective, partially cutaway view of a framed picture unit in accordance with the preferred embodiment of the present invention.
Figure 5:
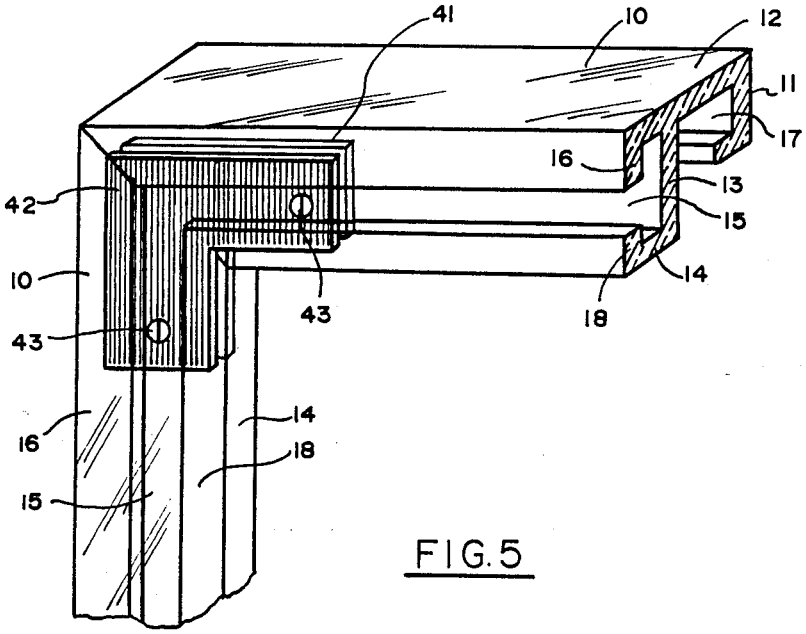
FIG. 5 is a detailed view showing the connection of two framing members.

In operation, four framing members 10 are cut out of one or more lengths of framing material 1, with the ends of framing members 10 being mitered at a 45° angle. Three framing members 10 are joined together with L-shaped joiner members 40; each joiner member 40 (see FIG. 5) comprises a blank L-shaped element 41, an L-shaped element 42 having two threaded holes therein and a screw 43 disposed within each threaded hole. Framing members 10 could instead be glued together, in which case groove 15 could be omitted. A picture assembly 20 (comprising a transparent protective cover 21, a mat 22, a picture 23 and a backing board 24) is inserted into the space between the front elements 11 and back elements 13 of framing members 10 (picture assembly 20 may sometimes comprise more or less parts than are shown). The fourth framing member 10 is then attached to the second and third framing members 10 to form frame 19 (FIG. 4). Depending upon the type of inserts 30, which serve as appearance altering material, to be placed in recesses 17, the inserts 30 may need to be placed in the space between front elements 11 and back elements 13 of framing members 10 before the fourth framing member is attached to the second and third framing members. If, for example, each insert 30 is a side of a mat made of single piece of mat board, inserts 30 would have to be inserted into the space between the front elements 11 and back elements 13 of framing members 10 before the fourth framing member is attached to the second and third framing members (otherwise, the inserts 30 would not be able to be inserted into recesses 17, since the mat made of a single piece of mat board would not fit into frame 19), and would be inserted into recesses 17 thereafter. Often, however, each insert 30 will comprise a discrete insert, such as a mitered piece of mat board as shown in FIG. 4, or each insert 30 may comprise a plurality of discrete elements, such as coins, for example. In either case, inserts 30 may be placed in the space between front elements 11 and back elements 13 before or after the fourth framing member is attached to the second and third framing members.

Once frame 19 is constructed and inserts 30 are in place in recesses 17, resilient biasing springs 45 (such as those shown in U.S. Pat. No. 4,525,945) are placed between backing board 24 and back elements 13 to frictionally secure assembly 20 within frame 19.

Figure 6:
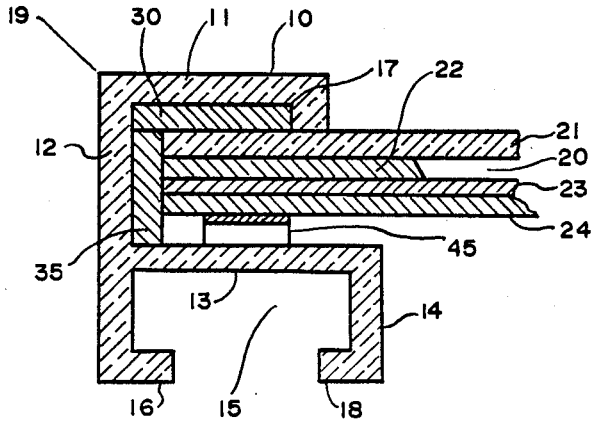
FIG. 6 is a cross-sectional, partially cutaway view of a framed picture unit using framing members of the preferred embodiment of the present invention.

In FIG. 6, an additional insert 35 is shown disposed between picture assembly 20 and outer side element 12. The purpose of insert 35 is to hide the edge of assembly 20; insert 35 may comprise any suitable material, such as mat board.

Figure 7:
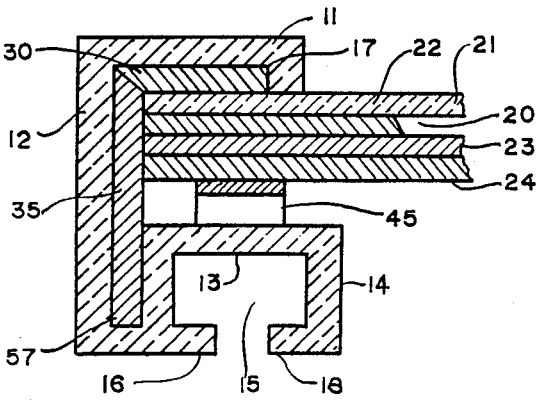
FIG. 7 is a cross-sectional, partially cutaway view of a framed picture unit using an alternative embodiment of the framing member of the present invention.

In framing member 50, shown in FIG. 7, a recess 57 is provided in outer side element 12 to allow insert 35 to extend back far enough to hide joiner members 40 from side view.

Figure 8:
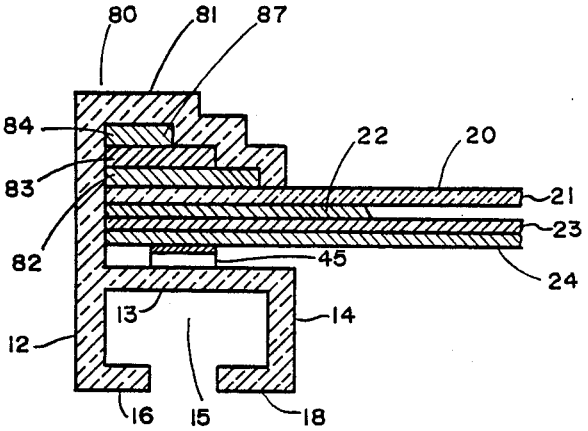
FIG. 8 is a view similar to that of FIG. 7, showing a third embodiment of the framing member of the present invention.

Framing member 80 (FIG. 8) has a stepped front element 81 and a stepped recess 87 therein. Disposed within stepped recess 87 are inserts 82, 83 and 84 which may comprise, for example, strips of mat board.

Figure 9:
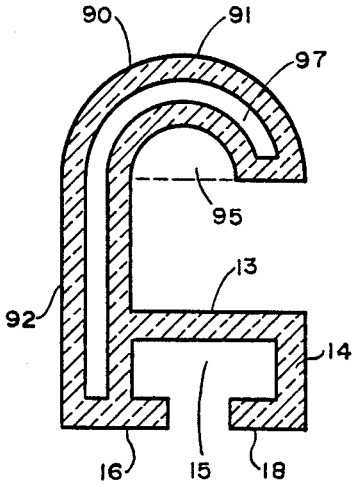
FIG. 9 is a cross-sectional view of a framing member in accordance with a fourth embodiment of the present invention.

Framing member 90 (FIG. 9) has a curved front element 91 in place of front element 11 of framing member 10. Disposed within front element 91 and outer side element 92 is a laterally closed hollow or cavity 97. Cavity 97 can receive decorative material such as, for example, sand, liquid, scored mat boards or sticks (preferably with their longitudinal axes parallel to that of framing member 90). If sticks are used, they are received in cavity 97 before frame 99 is constructed. If sand or liquid is used, the cavity 97 of each framing member 90 may be filled before constructing frame 99 (FIG. 10), or all cavities 97 may be filled once frame 99 has been constructed. In the former case, the cavity 97 of each framing member 90 may be filled by first closing an end of cavity 97 with, for example, transparent tape, pouring liquid or sand into cavity 97, and then sealing the other end of cavity 97 with, for example, transparent tape. In the latter case, a hole may be drilled in one of the framing members 90 of frame 99, and the cavities 97 are filled through the hole. The hole may then be closed with a plug 94. When cavity 97 is to be filled with liquid after frame 99 has been constructed, it might be advisable to glue framing members 90 together to prevent leakage from cavity 97. Also, gaskets could be used between adjacent framing members 90 to prevent leakage from cavities 97. If a transparent liquid is used in cavity 97, it may be desirable to also put an insert in recess 95 (the extent of recess 95 is indicated in phantom in FIG. 9).

Figure 11:
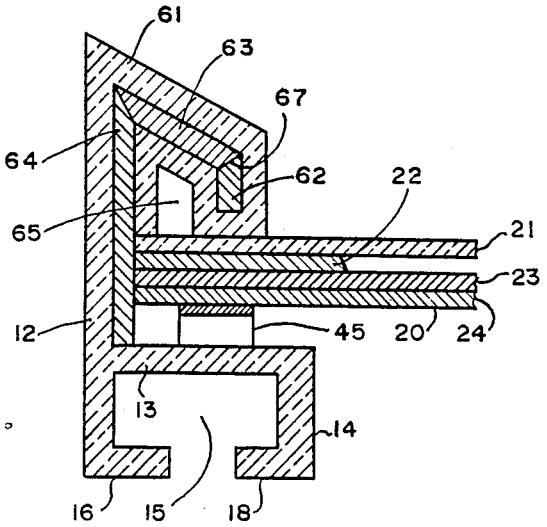
FIG. 11 is a view similar to that of FIG. 8, showing a framing member in accordance with a fifth embodiment of the present invention.

In framing member 60 (FIG. 11), front element 11 of framing member 10 is replaced by a front element 61 having a laterally closed hollow or groove 67 therein. Groove 67 is substantially J-shaped in cross-section, and may receive decorative inserts to change the appearance of framing member 60. In FIG. 11, inserts 62, 63 and 64 are shown disposed in groove 67. Inserts 62, 63 and 64 may comprise, for example, mat board. Insert 64 extends as far back as back element 13 to conceal the edge of picture assembly 20. If desired, insert 63 could be omitted and an insert could instead be placed in recess 65.

Figure 12:
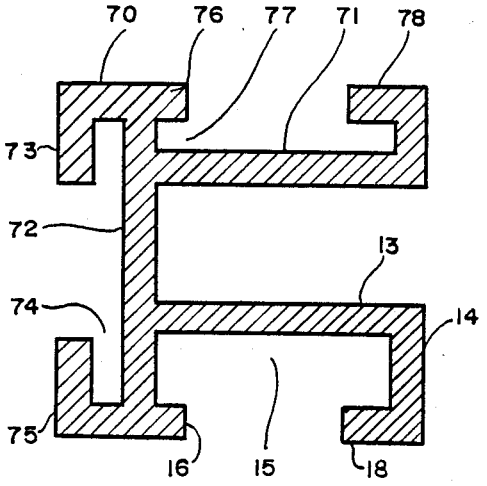
FIG. 12 is a cross-sectional view of a sixth embodiment of the framing member of the present invention.

In framing member 70 (FIG. 12) an outwardly-opening recess 77 is formed in front element 71, and an outwardly-opening recess 74 is formed in outer side element 72. Lips 73 and 75 help retain inserts 31 in recesses 74, and lips 76 and 78 help retain inserts 32 in recesses 77 (see FIG. 13). Since parts of inserts 31 and 32 are exposed, they are visible whether or nor framing member 70 is made of a transparent material; therefore, framing member 70 may be made of a translucent or opaque material. Framing member 70 may, for example, be made of metal or wood.

Figure 14:
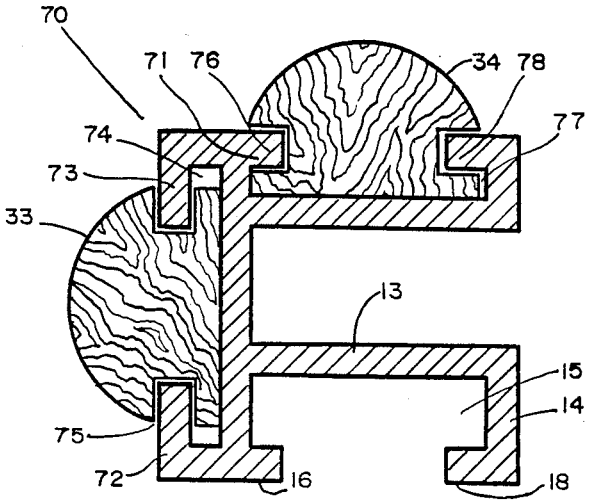
FIG. 14 is a cross-sectional, partially cutaway view of a framed picture unit employing the framing member of FIG. 12.

Recesses 74 and 77 may receive other types of decorative inserts, such as, for example, coins, metal strips, Formica strips or wood. In FIG. 14, inserts 33 and 34 are made of wood and are notched to engage in recesses 74 and 77, respectively.

Figure 10:
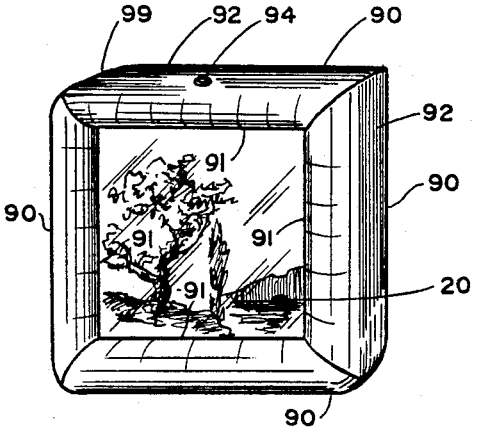
FIG. 10 shows a framed picture unit using the framing member of FIG. 9.
Figure 13:
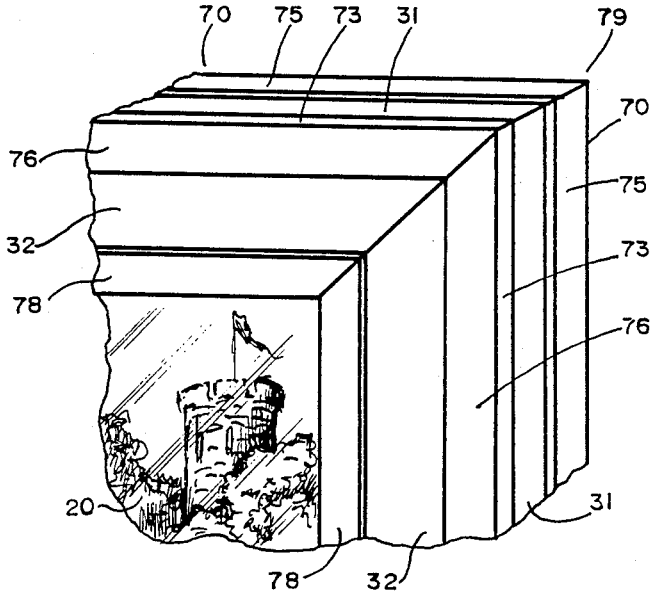
FIG. 13 shows a portion of a framed picture unit using the framing member shown in FIG. 12.

It can thus be seen that the present invention provides picture framing members whose appearance can be quickly and easily altered. The present invention provides a new artistic freedom in framing. If a framer has a desire to create a pattern within the frame, he can readily do so. After deciding on a design, the framer can select appropriate colors from, for example, scrap mat board, cut the mat board to create the pattern, and insert the patterned mat board into the recesses of the framing material. Whether or not mat board is used for the decorative inserts, mat 22 of picture assembly 20 may be omitted (as shown in FIGS. 10 and 13). The possible number of unique frames which can be made with the picture framing material of the present invention is virtually unlimited.

While a number of embodiments of the present invention have been shown and described herein, there are numerous modifications which could be made thereto without departing from the spirit or scope of the present invention. I therefore pray that my rights to the present invention be limited only by the following claims.

I claim:

1. Apparatus for framing pictures, said apparatus comprising a framing member for use in a framed picture unit in which a plurality of framing members form a picture frame, said framing member having:

at least a front element and a side element, at least one of the elements being internally configured for receiving an appearance-altering material therein, wherein:

at least one of the elements has a recess means therein adapted for receiving material for altering the appearance of the framing member;

said framing member is made of a transparent material;

said recess means comprises an inwardly opening recess;

said front element is substantially perpendicular to said side element;

said recess is formed in said front element; and said recess is configured to receive mat board therein.

2. A picture frame comprising:

a plurality of framing members, each framing member comprising at least a front element and a side element, at least one of the elements being internally configured for receiving an appearance-altering material therein, wherein:

at least one of the elements has a recess means therein adapted for receiving material for altering appearance of the framing member;

said framing member is made of a transparent material;

said recess is an inwardly opening recess;

said front element is substantially perpendicular to said side element;

said recess is made in said front element; and said recess is configured to receive mat board therein.

3. A picture frame comprising:

a plurality of framing members made of a transparent material, each framing member having a front element, a side element which is substantially perpendicular to the front element, and a back element which is substantially parallel to the front element, the front element having an inwardly-opening recess therein, said recess being configured to receive mat board therein.

4. Apparatus for framing pictures, said apparatus comprising a framing member for use in a framed picture unit in which a plurality of framing members form a picture frame, said framing member having:

at least a front element and a side element, the front element being internally configured for receiving an appearance-altering material therein, the framing member being made of a transparent material, wherein:

at least one of the elements has a recess means therein adapted for receiving material for altering the appearance of the framing member.

5. The apparatus of claim 4, wherein:

said recess means comprises an inwardly opening recess.

6. The apparatus of claim 5, wherein:

said recess is configured to receive mat board therein.

7. The apparatus of claim 4, wherein:

said recess means is a cavity.

8. A picture frame comprising:

a plurality of framing members made of a transparent material, each framing member comprising at least a front element and a side element, the front element being internally configured for receiving an appearance-altering material therein, wherein:

at least one of the elements has a recess means therein adapted for receiving material for altering the appearance of the framing member.

9. The picture frame of claim 8, wherein:

said recess means comprises an inwardly opening recess.

10. The picture frame of claim 9, wherein:

said recess is configured to receive mat board therein.

11. The picture frame of claim 8, wherein:

said recess means is a cavity.

* * * * *